United States Patent [19]

Moutrie et al.

[11] Patent Number: 4,551,696

[45] Date of Patent: Nov. 5, 1985

[54] NARROW BANDWIDTH MICROSTRIP FILTER

[75] Inventors: Michael F. Moutrie, Buffalo Grove; Raymond L. Sokola, Lake Zurich; Charles Choi, Schaumburg, all of Ill.

[73] Assignee: Motorola, Inc., Schaumburg, Ill.

[21] Appl. No.: 562,330

[22] Filed: Dec. 16, 1983

[51] Int. Cl.[4] ..... H01P 1/203; H01P 7/08

[52] U.S. Cl. ..... 333/204; 333/219; 333/246

[58] Field of Search ..... 333/202–212, 333/219–223, 238, 246; 331/96, 101, 102, 107 SL

[56] References Cited

U.S. PATENT DOCUMENTS

| | | | |
|---|---|---|---|
| 3,142,808 | 7/1964 | Gonda | 333/204 |
| 3,327,255 | 6/1967 | Bolljahn et al. | 333/202 |
| 3,348,173 | 10/1967 | Matthaei et al. | 333/204 |
| 3,391,356 | 7/1968 | Bolljahn et al. | 333/203 |
| 3,818,389 | 6/1974 | Fisher | 333/203 |
| 3,889,214 | 6/1975 | Petitjean et al. | 333/203 |
| 4,157,517 | 6/1979 | Kneisel et al. | 333/205 |
| 4,253,073 | 2/1981 | Stegens | 333/203 |
| 4,266,206 | 5/1981 | Bedard et al. | 333/204 |
| 4,281,302 | 7/1981 | Stegens | 333/204 |
| 4,340,873 | 7/1982 | Bastida | 333/161 |
| 4,418,324 | 11/1983 | Higgins | 333/204 |

*Primary Examiner*—Marvin L. Nussbaum
*Attorney, Agent, or Firm*—Rolland R. Hackbart; Edward M. Roney; James W. Gillman

[57] ABSTRACT

An interdigital microstrip transmission line filter (100) includes three electrically conductive strips (104, 106 and 108) each coupled to grounded portions (110 and 120) on one end and coupled to respective capacitive loading pads (112, 116 and 114) on the other end. Input and output pads (130 and 140) may be coupled to signals from other circuitry located off or on the same substrate (150). Grounded portion (110) extends between capacitive loading pads (112 and 114) for minimizing undesired coupling between non-adjacent strips (104 and 108). As a result, the unique microstrip filter (100) has a frequency response that is substantially devoid of passband transmission zeros.

12 Claims, 2 Drawing Figures

NARROW BANDWIDTH MICROSTRIP FILTER

BACKGROUND OF THE INVENTION

The present invention general relates to transmission line filters and more particularly to interdigital microstrip filters having a narrow bandwidth which is substantially devoid of passband transmission zeros.

One type of conventional transmission line filter is the strip line filter consisting of a series of electrically flat conductive strips placed between two dielectric substrates each having an electrically grounded outside surface. Such strip line filters are typfied by those described in U.S. Pat. Nos. 4,157,517, 4,266,206 and 4,418,324 (all incorporated herein by reference thereto). The construction and tuning of such stripline filters is complicated due to the fact that the conductive strips are sandwiched between dielectric substrates having plated outside surfaces.

Another type of transmission line filter is a microstrip filter having a single substrate with a ground plane on one surface and electrically conductive strips on the other surface. The frequency response of such microstrip filters may be degraded by a transmission zero located near the center of the desired filter passband. This phenomenon is illustrated by dashed-line frequency response 200 in FIG. 2. This problem can be alleviated in some microstrip filters by attaching discrete tunable capacitors to the free ends of the strips. However, manually mounting and tuning these capacitors adds to the manufacturing cost of such microstrip filters. Another problem with the frequency response of such microstrip filters is the relatively wide lower frequency skirt. The slope of the lower frequency skirt can be improved somewhat by means of a metal cover that is placed over the strips. Use of such metal covers is described in further detail in U.S. Pat. No. 4,281,302. However, the use of such covers not only complicates the design of, but also increases the cost of, such microstrip filters.

OBJECTS AND SUMMARY OF THE INVENTION

Accordingly, it is an object of the present invention to provide an improved and inexpensive microstrip filter that has a narrow bandwidth substantially devoid of passband transmission zeros.

It is another object of the present invention to provide an improved microstrip filter that can be automatically tuned by removing material from the conductive strips or ground plating thereon.

It is that a futher object of present invention to provide an improved microstrip filter that can be placed on a substrate with other related circuitry for minimizing circuitry cost and interconnections.

Briefly described, the present invention encompasses a microstrip transmission line filter having a predetermined signal frequency passband. The unique filter includes a substrate having a first surface and an electrically grounded second surface, a plurality of substantially parallel electrically conductive strips disposed on the first surface of the substrate each having a free end and a grounded end, and an electrically conductive grounded portion disposed on the first surface of the substrate and extending at least partially between predetermined ones of the free ends of the strips. The free ends of the strips may also be coupled to capacitive loading pads likewise disposed on the first surface of the substrate.

DETAILED DESCRIPTION OF THE PREFERRED EMBODIMENT

Figure 1:
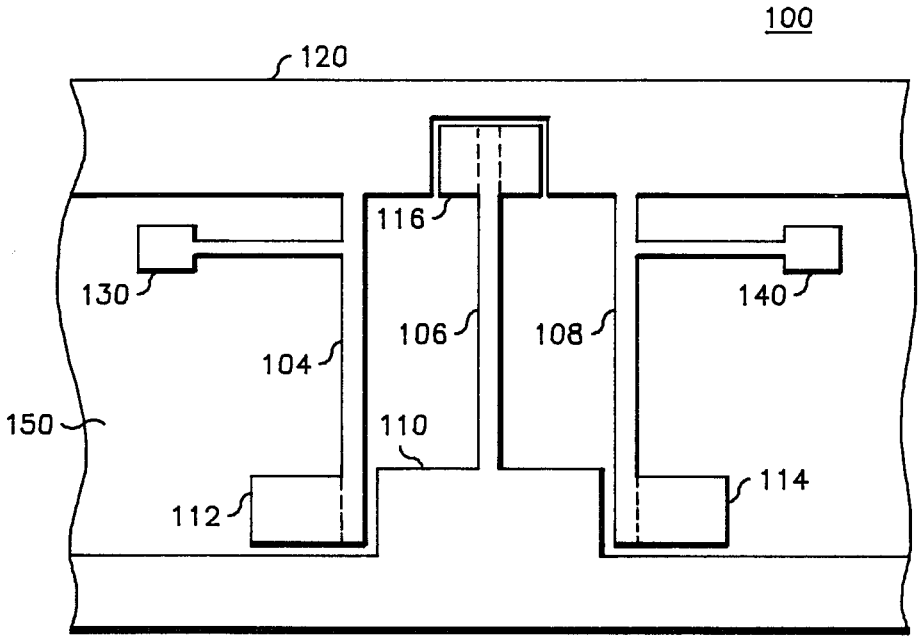
FIG. 1 is a top view of an interdigital microstrip filter embodying the present invention.

In FIG. 1, there is illustrated an interdigital microstrip filter 100 embodying the present invention. Filter 100 includes a substrate 150 preferably comprised of alumina ($Al_2O_3$) having a conductive grounded bottom surface connected to grounded portions 110 and 120 on the top surface by plated through holes or by plating around the edges of the substrate 150. Filter 100 further includes parallel electrically conductive strips 104, 106 and 108 connected on one end to grounded portions 110 or 120 and connected on the other end to respective capacitive loading pads 112, 116 and 114. Input and output signals may be applied to filter 100 by means of conductive pads 130 and 140. Moreover, filter 100 may be placed on the same substrate as related circuitry and directly connected thereto.

Strips 104, 106 and 108 of filter 100 operate as transmission line resonators forming a three-pole bandpass filter. Inter-resonator coupling is primarily controlled by the spacing between strips 104, 106 and 108. Parallel plate capacitors are formed by plated pads 112, 116 and 114, which capacitively load the ends of respective strips 104, 106 and 108. Strips 104, 106 and 108 are substantially all the same length. When loaded by pads 112, 116 and 114, strips 104, 106 and 108 are less than one-quarter wavelength at the passband center frequency. If pads 112, 116 and 114 are not used (as illustrated by dotted lines in FIG. 1), strips 104, 106 and 108 are substantially one-quarter wavelength long.

According to an important feature of the present invention, grounded portion 110 extends at least partially between capacitive loading pads 112 and 114 for minimizing undersired coupling between strips 104 and 108. By arranging filter 100 such that capacitive pads 112 and 114 are substantially surrounded by ground plating, conductive strips 104 and 108 are predominantly inductively coupled. As a result, the frequency response of filter 100 is substantially devoid of passband transmission zeros.

Figure 2:
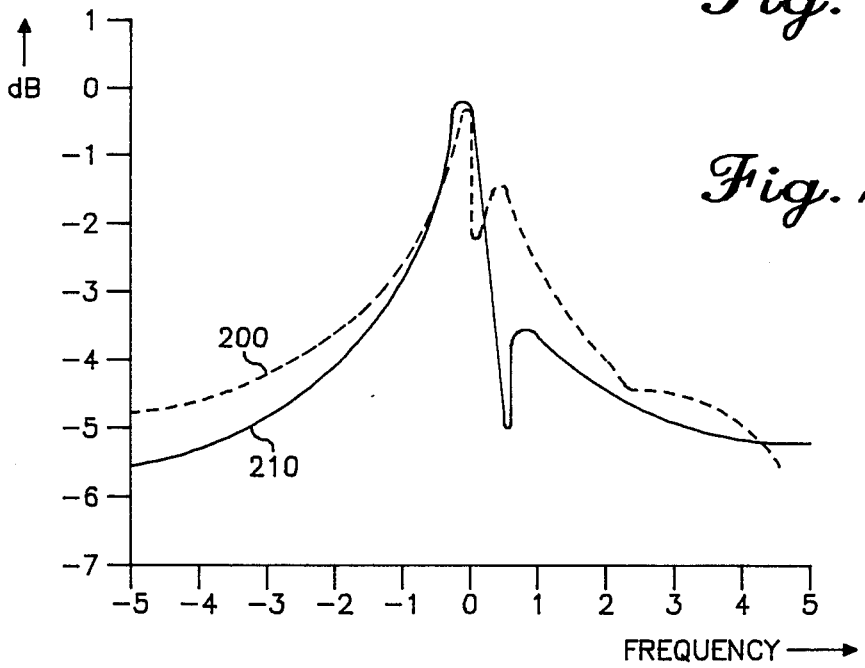
FIG. 2 shows a typical frequency response 200 of a prior art microstrip filter and a typical frequency response 210 of a microstrip filter embodying the present invention.

This feature of the present invention is illustrated more clearly by the typical frequency responses shown in FIG. 2. In FIG. 2, each division on a vertical axis represents 10 dB relative to a 0 dB reference, and each division on a horizontal axis represent 100 MHz relative to the center frequency of the filter passband. The frequency response 200 of prior art microstrip filters is subject to a transmission zero located approximately at the center of the desired passband. By utilizing the present invention, the transmission zero in frequency response 210 of filter 100 is moved approximately 50 MHz away from the center frequency of the filter passband. Moreover, frequency response 210 of filter 100 of the present invention is much more selective than prior art frequency response 200. Thus, the present invention not only eliminates the adverse affects of the transmission zero, but also provides a narrower and more selective filter passband.

In an alternative embodiment of the present invention illustrated by dotted lines in FIG. 1, pads 112, 116 and 114 are not utilized, and strips 104, 106 and 108 are substantially one-quarter wavelength long. This microstrip filter is likewise subject to undesired coupling between the free ends of strips 104 and 108. According to the present invention, extending grounded portion 110 at least partially between the free ends of strips 104 and 108 similarly minimizes undesired coupling therebetween, whereby the frequency response of such a filter is substantially devoid of passband transmission zeros.

Although grounded portion 110 extends to the top of capacitive loading pads 112 and 114 in FIG. 1, grounded portion 110 may extend further toward the free end of strip 106 or may not reach the top of pads 112 and 114 depending on the desired filter response. Also, since strips 104, 106 and 108 are substantially the same length, strip 106 and associated pad 116 extend into grounded portion 120.

According to another feature of the present invention, filter 100 can be automatically tuned by selectively removing plating from capacitive loading pads 112, 116, 114 or grounded portions on the top or bottom of the substrate 150. For example, the plating can be automatically removed by means of laser trimming equipment. Because filter 100 can be automatically tuned, it is much less costly to manufacture than prior art sandwiched strip line filters and prior art covered or discretely loaded microstrip filters.

In summary, an improved narrow bandwidth microstrip filter has been described. The novel microstrip filter has a frequency response that is substantially devoid of passband transmission zeros. The novel filter is less expensive than prior art filters because it can be automatically tuned and does not require a separate metal or substrate cover. The microstrip filter of the present invention can be advantageously utilized in any suitable filtering application where a narrow bandwidth is required.

We claim:

1. A microstrip transmission line filter having a predetermined signal frequency passband, comprising:

a substrate having a first surface and an electrically grounded second surface;

at least two electrically conductive, opposingly disposed grounded portions on the first surface of said substrate;

a plurality of substantially parallel electrically conductive strips disposed on the first surface of said substrate and each having a free end and a grounded end coupled to one of said grounded portions;

at least two capacitive loading means disposed on the first surface of said substrate and each coupled to a different one of the free ends of said strips coupled to the same one of said grounded portions; and one of said grounded portions further including at least one additional electrically conductive grounded portion interposed at least partially between said two capacitive loading means.

2. The filter according to claim 1, further adapted to filter an input signal from a signal source, said filter further including input and output means each disposed on the first surface of said substrate and coupled to respective ones of said strips, the input signal from the signal source being coupled to the input means, and the output means providing the filtered input signal.

3. The filter according to claim 1, wherein each of said strips further includes an electrically conductive pad at its free end.

4. A microstrip transmission line filter having a predetermined signal frequency passband, comprising:

a substrate having a first surface and an electrically grounded second surface;

a plurality of substantially parallel electrically conductive strips disposed on the first surface of said substrate and each having a free end and a grounded end;

a plurality of capacitive loading means disposed on the first surface of said substrate and each coupled to respective free ends of said strips; and electrically conductive grounding means disposed on the first surface of said substrate and interposed at least partially between predetermined ones of said capacitive loading means.

5. The filter according to claim 4, further adapted to filter an input signal from a signal source, said filter further including input and output means each disposed on the first surface of said substrate and coupled to respective ones of said strips, the input signal from the signal source being coupled to the input means, and the output means providing the filtered input signal.

6. The filter according to claim 4, wherein each of said capacitive loading means includes an electrically conductive pad.

7. A microstrip transmission line filter having a predetermined signal frequency passband and being adapted to filter an input signal from a signal source, comprising:

a substrate having a first surface and an electrically grounded second surface;

at least three substantially parallel electrically conductive strips disposed on the first surface of said substrate and each having a free end and a grounded end, the free ends of the outside conductive strips being adjacent to the grounded end of the middle conductive strip;

at least three capacitive loading means disposed on the first surface of said substrate and each coupled to respective free ends of said strips; and electrically conductive grounding means disposed on the first surface of said substrate and interposed at least partially between said capacitive loading means coupled to the outside conductive strips.

8. The filter according to claim 7, wherein each of said capacitive loading means includes an electrically conductive pad.

9. A microstrip transmission line filter having a predetermined signal frequency passband and being adapted to filter an input signal from a signal source, comprising:

a substrate having a first surface and an electrically grounded second surface;

at least two electrically conductive, opposingly disposed grounded portions on the first surface of said substrate;

at least three substantially parallel electrically conductive strips disposed on the first surface of said substrate and each having a free end and a grounded end coupled to one of said grounded portions, the free ends of the outside conductive strips being adjacent to the grounded end of the middle conductive strip;

at least two capacitive loading means disposed on the first surface of said substrate and each coupled to a different one of the free ends of the outside conductive strips; and one of said grounded portions further including at least one additional electrically conductive grounded portion interposed at least partially between the free ends of the outside conductive strips.

10. The filter according to claim 9, wherein each of said strips further includes an electrically conductive pad at its free end.

11. A microstrip transmission line filter having a predetermined signal frequency passband, comprising:

a substrate having a first surface and an electrically grounded second surface;

a plurality of substantially parallel electrically conductive strips disposed on the first surface of said substrate and each having a free end and a grounded end;

at least two capacitive loading means disposed on the first surface of said substrate and each coupled to a different one of substantially adjacent free ends of said strips; and electrically conductive grounding means disposed on the first surface of said substrate and interposed at least partially between said two capacitive loading means.

12. A microstrip transmission line filter having a predetermined signal frequency passband and being adapted to filter an input signal from a signal source, comprising:

a substrate having a first surface and an electrically grounded second surface;

at least three substantially parallel electrically conductive strips disposed on the first surface of said substrate and each having a free end and a grounded end, the free ends of the outside conductive strips being adjacent to the grounded end of the middle conductive strip;

at least two capacitive loading means disposed on the first surface of said substrate and each coupled to a different one of the free ends of the outside conductive strips; and electrically conductive grounding means disposed on the first surface of said substrate and interposed at least partially between the free ends of the outside conductive strips.

* * * * *